United States Patent [19]

Corey

[11] Patent Number: 4,984,432

[45] Date of Patent: Jan. 15, 1991

[54] ERICSSON CYCLE MACHINE

[76] Inventor: John A. Corey, R.D. #1, Box 410, Melrose, N.Y. 12121

[21] Appl. No.: 424,807

[22] Filed: Oct. 20, 1989

[51] Int. Cl.[5] ..... F25B 9/00

[52] U.S. Cl. ..... 62/87; 62/402; 62/467; 417/69

[58] Field of Search ..... 62/499, 467, 116, 500, 62/87, 402; 417/69

[56] References Cited

U.S. PATENT DOCUMENTS

| | | | |
|---|---|---|---|
| 3,079,764 | 3/1963 | Westcott, Jr. | 62/467 |
| 3,623,332 | 11/1971 | Fernandes . | |
| 3,791,167 | 2/1974 | Eskeli . | |
| 3,808,828 | 5/1974 | Kantor | 62/116 |
| 4,211,092 | 7/1980 | Ludin et al. | 62/499 |
| 4,287,138 | 9/1981 | Buckner . | |
| 4,295,518 | 10/1981 | Rannenberg . | |
| 4,353,218 | 10/1982 | Wheatley et al. | 62/467 |
| 4,433,551 | 2/1984 | Dibrell | 62/499 |
| 4,484,457 | 11/1984 | Mugele | 417/69 |
| 4,501,122 | 2/1985 | Cutler | 62/467 |
| 4,503,683 | 3/1985 | Wieland et al. . | |

*Primary Examiner*—Ronald C. Capossela
*Attorney, Agent, or Firm*—Schmeiser, Morelle & Watts

[57] ABSTRACT

An Ericsson cycle machine is disclosed which can be used for refrigeration, liquefaction of nitrogen or as an engine. The invention includes a liquid ring compressor linked to a liquid ring expander by a gas loop that includes a recuperator. As a refrigeration unit, the liquid ring in the compressor is channeled through a heat exchanger to reject waste heat and liquid is tapped from the expander liquid ring and used as a refrigerant.

31 Claims, 4 Drawing Sheets

BRAYTON

ERICSSON

STIRLING

ERICSSON CYCLE MACHINE

FIELD OF THE INVENTION

The invention is in the field of Ericsson cycle machines. More particularly, the preferred embodiment is a refrigeration machine that uses a rotary compressor, rotary expander and two types of working fluids.

BACKGROUND OF THE INVENTION

Most common fluid-circulating refrigeration systems use a vapor-compression (V-C) cycle. In this type of device, a fluid is first compressed by adding work in a substantially adiabatic process, thereby raising its pressure and temperature. The fluid then passes through a heat exchanger (condenser) where its temperature is lowered and its pressure is only minimally decreased. Next, the fluid passes through an expansion valve where it is expanded without work recovery in a substantially isenthalpic process with a subsequent decrease in pressure and temperature. This low pressure, low temperature fluid then passes through another heat exchanger (evaporator) where the fluid acts as a refrigerant and absorbs heat energy. The fluid is then returned to the compressor completing the cycle.

In the early days of mechanical refrigeration, ammonia was a common working fluid in vapor-compression systems. It is still in wide commercial use in Europe despite its toxicity and corrosive nature. Other fluids once widely used include carbon dioxide (relatively safe, but requiring high pressures), sulfur dioxide (very corrosive, strong irritant) and methyl chloride (flammable carcinogen). All these were supplanted except in specialty use by the family of chloroflourocarbons (CFC's) developed originally by the Dupont Co., many of which are non-toxic and inflammable. These compounds (for example—FREON (TM)) have come to dominate the refrigeration and air conditioning industry.

It is known that the chlorine in these CFC compounds reacts with and destroys ultraviolet radiation-absorbing ozone in the upper atmosphere. Therefore, the release of CFC's after use (or by leakage) might result in grave ecological damage. Such ozone depletion has been found and measured over both poles of the Earth, leading to an international agreement to limit the production and use of CFC's. Currently, a major effort is underway to replace these compounds in refrigeration and air-conditioning systems.

One proposed solution is to use a gas (air) cycle refrigeration system. An example of this type of system is the reverse Brayton cycle commonly used aboard jet aircraft for cooling of the cabin. Air is bled from the discharge of the main-engine compressor and then is normally expanded through a small turbine. The air becomes cool during the expansion process and is subsequently used for cooling the cabin. Thus, no liquid-gas phase change occurs in a gas cycle refrigeration system.

There are other fundamental differences between V-C and gas cycle refrigeration systems. A vapor-compression cycle has a high coefficient of performance (COP) due to its close approach to the ideal Carnot cycle. This occurs because there is nearly isothermal heat exchange in the evaporation and condensation portions of the cycle. It is clear that alternative cycles proposed to match or exceed the performance of a V-C system should also approach these ideal isothermal processes.

One other advantage of V-C machines relative to gas-cycle machines is that the large enthalpy of phase change during the isothermal processes allows for a large refrigeration effect for each mass unit of fluid. This reduces the mass of fluid required and thus the size of the attendant machinery. The inherent disadvantage of this aspect of V-C machines is that the saturation conditions of the working fluid define the operating pressure required for the refrigeration system at any desired operating temperature. It is this characteristic that has led to the almost universal use of certain CFC's (e.g. R-12) in refrigeration systems. Therefore, attention is being focused on pressurized gas cycles that can provide the same advantages as V-C machines without a dependence on a CFC as the working fluid.

Gas cycles of interest include the Brayton, Stirling and Ericsson. Comparative temperature/entropy diagrams are shown in FIG. 1.

The Brayton cycle, as already discussed (reverse cycle for refrigeration), is the most familiar. This cycle is composed of a substantially adiabatic compressor, which compresses and sends gas to a first heat exchanger where heat energy is added at substantially constant pressure (heat energy is removed in the reverse cycle). Next, the gas passes to a turbine, where it is expanded in a substantially adiabatic process. After leaving the turbine, the gas (now cooler) is directed to a second heat exchanger, where heat energy is removed at substantially constant pressure (heat energy is added in the reverse cycle). The gas then returns to the compressor thereby completing the cycle. In the idealized Brayton cycle, the compression and expansion of the gas is considered isentropic (adiabatic). The efficiency of the Brayton cycle is dependent on the pressure ratios across the compressor and turbine. The primary disadvantage of this cycle for refrigeration uses results from its constant entropy processes which require a greater net work input (therefore lower COP) for compression and expansion at given temperatures, than cycles with isothermal processes.

The Stirling cycle consists of an isothermal compression, followed by a constant volume heating. After the heating, there is an isothermal expansion stage, finally followed by a constant volume cooling. A regenerator may be placed in the system so that some of the heat rejected in the cooling stage can be used in the heating stage. This cycle offers the potential of higher performance by its isothermal (together with constant-volume) processes. Unfortunately, known practical embodiments of this cycle require discrete pistons to approximate the constant-volume processes. Stirling cycles using reciprocating hardware are currently being developed for automotive and small electricity generating systems and have even been considered for powering artificial hearts. These systems typically use a gas in a closed cycle. Since the cycle pressure is essentially uniform throughout the machine at any one time, the pressure ratio, and thereby the specific power, depend directly on the ratio of total cycle volume to cyclically-changing (swept) volume. This places severe restrictions on the sizing and placement of heat exchangers filled with cycle gas. Furthermore, such machines cannot achieve isothermal processes with pistons-in-cylinders construction; therefore all known Stirling engines are, in fact, pseudo-Stirlings. Present Stirling engines are characterized by near-adiabatic compression and expansion processes that blend without sharp distinction into the approximately constant volume legs of the cycle. For this reason, Stirling machines do not achieve high COP at the moderate temperature ratios typical of refrigeration.

The most attractive gas cycle, theoretically, is the Ericsson cycle, defined by isothermal heat exchange processes and constant-pressure temperature change processes (typically regenerated). The earliest engines designed to operate on the Ericsson cycle were essentially open-cycle versions of the Stirling cycle where valves periodically connected the cycle spaces to atmospheric pressure. These early machines, because of their low speed and low power density, attracted no more than limited interest. However, the isothermal legs of the cycle promise a high COP.

A Brayton cycle machine, with the addition of a regenerator and numerous reheat stages (associated with multi-stage turbines) and numerous intercooling stages (associated with multi-stage compressors) can approach the theoretical processes and COP of the Ericsson cycle. The major problem with this type of modification is the non-isothermal compression and expansion of each stage, requiring many stages with attendant cost and complexity to achieve high COP.

SUMMARY OF THE INVENTION

The inventor has devised a unique Ericsson cycle machine that uses two different working fluids, a regenerative recuperator, a liquid ring expander and a liquid ring compressor. As a (reverse-cycle) refrigeration unit, the cycle parameters approach those of a reverse Ericsson cycle with nearly isothermal pressure changes and nearly constant pressure temperature changes. The cycle does not have the same saturation-point pressure constraints suffered by V-C systems, therefore a CFC working fluid is not required.

In the instant invention, a rotary liquid ring compressor is used to compress a gas in a substantially isothermal process while rejecting heat to a liquid. The gas is then directed to a recuperator where it is cooled to near the refrigeration temperature. After passing through the recuperator, the gas goes to a liquid ring expander where it is expanded in a substantially isothermal process, and at the same time, accepts heat energy from a liquid. The gas then leaves the expander, travels back through the recuperator, where it receives the heat energy from the gas leaving the compressor to raise it to near the rejection temperature, and proceeds back to the compressor. During the compression process, the heat energy accepted at the refrigeration temperature is rejected to a liquid and the cycle begins again.

Liquid is tapped from the liquid ring of the compressor and is sent through a first heat exchanger, where heat is rejected to a sink (e.g. the atmosphere). The cooled liquid is then returned to the liquid ring. In the process, it absorbs heat energy from the relatively hot gas being compressed. The liquid associated with the liquid ring of the compressor is used to remove heat energy from the gas during its compression and maintain its temperature substantially constant during the process.

Liquid is also tapped from the expander liquid ring. This liquid passes through a second heat exchanger where it accepts heat and acts as a refrigerant. The liquid then returns to the liquid ring. In the process, it transfers heat energy to the relatively cooler gas being expanded. The liquid associated with the ring in the expander is used to add heat to the gas during expansion and maintain its temperature substantially constant during that process.

Heat transfer between the gas and liquid in the compressor and expander is enhanced by injecting the liquid returning from the appropriate heat exchanger as a mist into the gas entering the compressor/expander inlet or interior chambers. This creates a large surface contact area for heat transfer between the liquid droplets and the gas and, in this way, brings the heat exchange processes closer to isothermal conditions, thereby greatly increasing the COP.

To modulate the capacity of the machine (extremely difficult with ordinary piston or screw compressors), a simple differential pressure regulator can be installed on one or both of the liquid rings to control the ring depth. The swept volume is a function of the liquid column height. Since the columns act as pistons, moving the ring inner surface radially effectively moves the piston faces, altering the clearance volumes, and thereby pressure ratio. Theoretically and ideally, no efficiency penalty results.

The instant invention allows a compact assemblage for a refrigeration machine that does not require the use of a CFC compound. The liquid ring in the compressor and expander take the place of pistons, thereby avoiding the friction, maintenance and wear associated with conventional piston systems.

The system of the instant invention is also used for purposes other than refrigeration. By providing a heat source at a higher temperature than the expander and allowing a sink below the temperature of the compressor, with the expander temperature above that of the compressor, the system acts like an engine. Also, the use of an additional pressurized fluid loop with the basic refrigeration machine allows cryogenic applications for the cycle such as the liquefaction of nitrogen.

DESCRIPTION OF THE PREFERRED EMBODIMENT

Figure 1A:
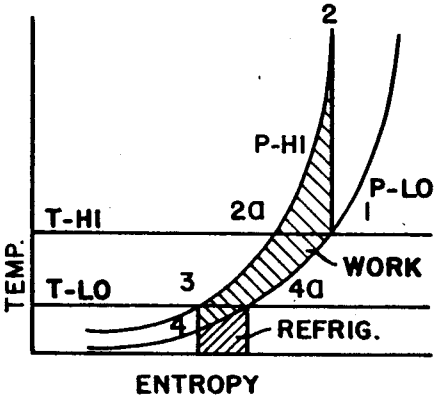
FIG. 1 is a series of temperature/entropy diagrams depicting Brayton, Ericsson and Stirling cycles.
Figure 1B:
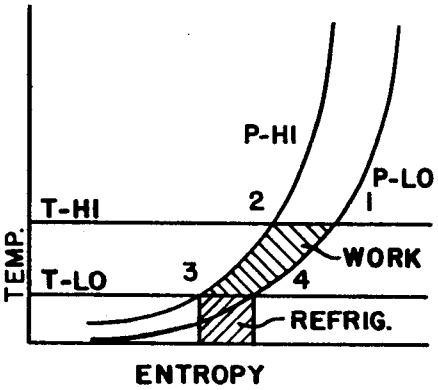
Figure 1C:
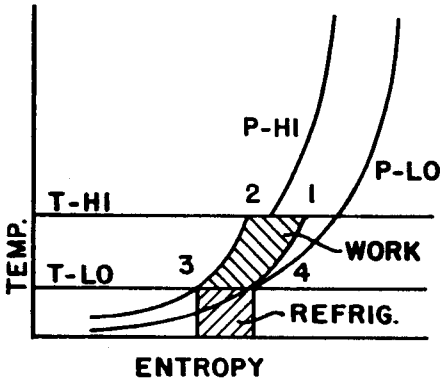
Figure 2:
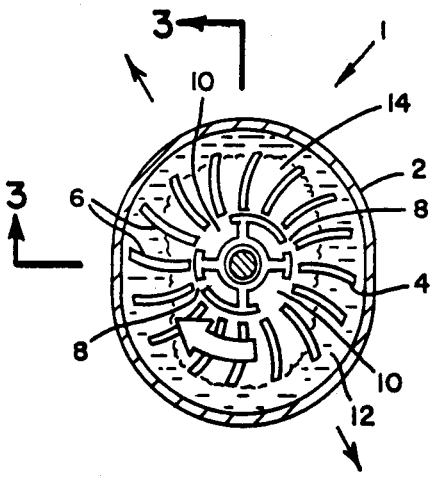
FIG. 2 PRIOR ART
FIG. 2 is a schematic of a liquid ring compressor (expander)
Figure 3:
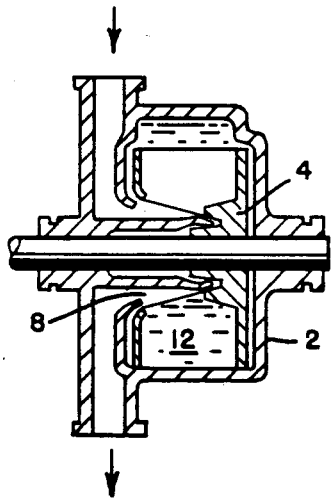
FIG. 3 PRIOR ART
FIG. 3 is a section view of a liquid ring compressor (expander)

A liquid ring compressor which also functions as an expander is a major component of the instant invention. This type of device, in crude form, is available from the Nash Engineering Company of Norwalk, Conn.. FIGS. 2 and 3 are similar to figures printed in a recent Nash catalog. FIG. 2 shows a cut-away elevation view of the compressor (expander) and FIG. 3 shows a cut-away sectional view of the compressor (expander).

The compressor (expander) 1 has an outer housing 2. The housing is oval-shaped and contains a rotor 4. The rotor includes a plurality of vanes 6. There are two discharge ports 8 and two inlet ports 10. When used as an expander, the rotor (preferably) turns in the opposite direction and has inlet ports at 8 and discharge ports at 10. A quantity of liquid 12 (shaded region) is shown within the housing and amidst the vanes.

The function of the compressor (expander) is as follows. A rotating band of liquid 12 rotates with the rotor 4 which impels it to do so by the action of the vanes. The liquid is constrained radially only by the housing and travels in an oval path, moving outward at the inlet ports and inward at the outlet ports. In this way, the liquid almost fills each rotor chamber 14 (between rotor vanes) twice during each full revolution of the rotor. At these points, the gas in the chamber undergoes maximum compression.

When acting as a compressor, the lower portion of FIG. 3 shows a chamber at a full compression stage just after the discharge port 8 has been uncovered. At this point, the rotor vanes bracketing the chamber are adjacent either the right or left side of the housing (per FIG. 2). In this position, the liquid fills the chamber to the maximum extent, thereby fully compressing the gas trapped between the adjacent rotor vanes.

The upper portion of FIG. 3 shows a chamber situated 90 degrees from the chamber shown in the lower portion of the figure. The inlet ports 10 extend for a large portion of the intake stage (FIG. 2 shows the intakes each uncovered for about 70 degrees of the rotor rotation). As the rotor vanes rotate from a position nearest one of the sides towards a position near the top or bottom of the housing (per FIG. 2), the volume of liquid within the chamber between adjacent vanes decreases. This creates a low pressure region which, when the appropriate inlet port is uncovered, causes new gas to be drawn into the chamber. When the vanes are at a position closest to the top or bottom of the housing, the chamber between the vanes is at a maximum intake position and contains its maximum charge of gas. As the rotor rotation continues, the inlet port is closed off, and the compression stage begins.

When acting as an expander, and as illustrated in the lower portion of FIG. 3, the inlet port 8 becomes uncovered. A small charge of compressed gas enters the chamber between the vanes. As the rotor continues to turn, the inlet port is passed and the volume of liquid within the chamber decreases. This causes the gas to expand and thereby reduce its temperature. When the discharge port 10 is uncovered, the rotor turns and the vanes approach the sides of the housing where the fluid again refills the chamber. This forces the expanded gas out of the chamber without significantly increasing its pressure.

Figure 4:
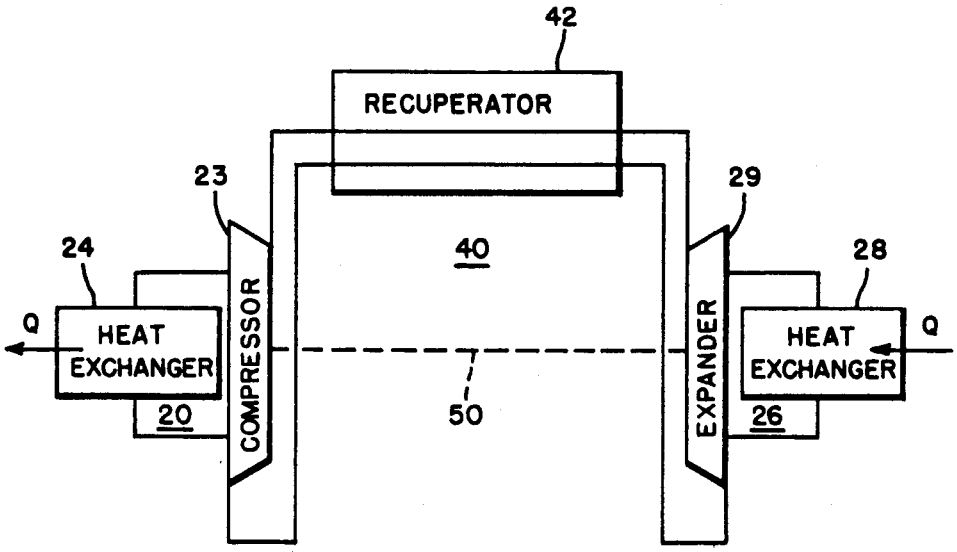
FIG. 4 is a schematic of the Reverse-Ericsson refrigeration system.
Figure 5:
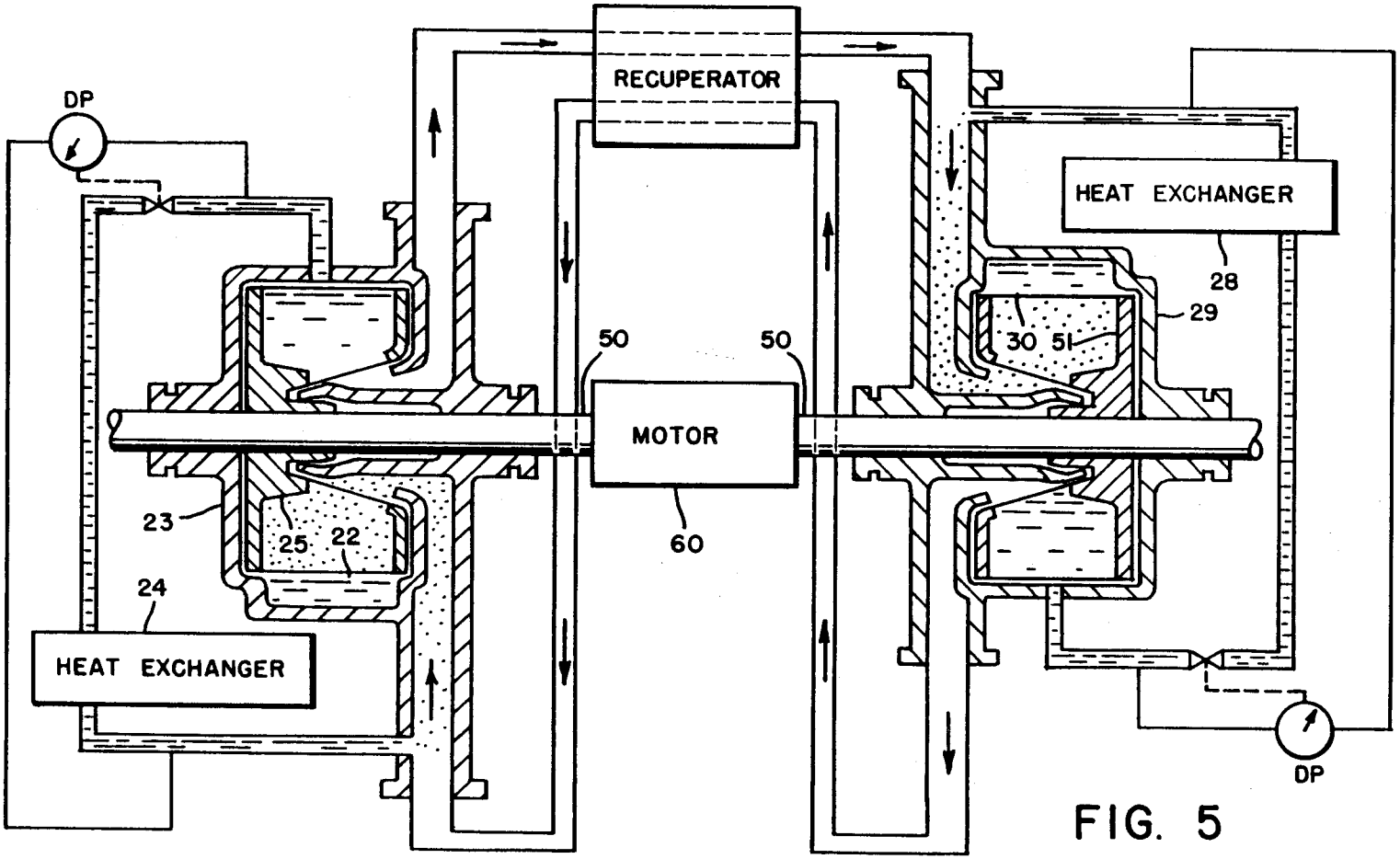
FIG. 5 is a detailed sectional view of the fluid ring compressor and expander placed in the system.

The instant invention, when acting as a refrigeration system, comprises three fluid loops. This is schematically shown in FIGS. 4 and 5. A first loop 20 uses a liquid as the fluid and functions to reject heat from the system. The loop taps liquid from the liquid ring 22 (the ring of liquid 12) of the compressor 23 and cycles the liquid through a heat exchanger 24 before returning the liquid to the compressor liquid ring. In the heat exchanger 24, heat is transferred from the liquid to either another liquid or to a gas (atmospheric air, for example).

A second loop 26 also uses a liquid as the fluid. In this loop, heat is transferred into the liquid from a heat exchanger 28 to accomplish refrigeration. The liquid is tapped off the liquid ring 30 in the expander 29, sent through heat exchanger 28 where it receives heat energy, then it is returned back to the expander liquid ring.

The third loop 40 uses a gas as the fluid. This loop ties the system together and is used to transfer heat between the expander 29 and the compressor 23. In this loop, a high pressure gas is expanded in the expander 29 reducing its temperature. The cooled gas absorbs heat energy from the expander liquid loop 26 and then, when the rotor turns to a point where the gas containing chamber begins a compression stage, the gas discharge port is uncovered and the expanded gas is forced towards the compressor 23. The now lower-pressure gas passes through a recuperator 42 where it accepts heat energy from a hotter, higher-pressure gas leaving the compressor. As the compressor rotor 25 turns to a point where a chamber is in an inlet stage (the inlet port is uncovered), the warmed lower-pressure gas is received and then compressed. This raises the temperature of the gas. During the period of compression, the hot gas transfers some of its heat energy to the compressor liquid ring 22 where it is rejected in the compressor liquid loop 20 by heat exchanger 24. This hot, higher-pressure gas is then directed back towards the expander as an outlet port is uncovered. The gas passes through the recuperator 42 where it gives up a large amount of its heat to the cooler, lower-pressure gas about to enter the compressor. The cooled, higher-pressure gas now enters the expander at an inlet stage (when the inlet port is uncovered) and the cycle is repeated.

A shaft 50 links the compressor rotor 25 and the expander rotor 51 so that some of the expansion work can be recovered and used in the compression stage. In the preferred embodiment, a single motor 60 is operatively connected to the shaft driving both the compressor and the expander.

In the preferred embodiment of the instant invention, the heat transfer in the compressor and expander is enhanced by a liquid injection system. The liquid returning from the heat exchanger is injected into the gas to be compressed (in the compressor, expanded in the expander). The liquid is in a fine mist form which provides a large surface area for improved heat transfer. The mist intimately contacts the gas and conforms its overall shape to match the decreasing (in the compressor, but increasing in the expander) chamber volume. Ideally, the mist droplets would be uniform in size and distribution. As the rotor of the compressor (or expander) turns, the liquid mist is centrifuged to the outer periphery of the chamber between the rotor vanes where it joins with the liquid ring, thereby replenishing the liquid in the ring (which is tapped to supply the liquid loops) and substantially maintaining the ring's temperature by transferring heat energy between the gas and the liquid.

Movement of liquid through either liquid loop is driven by the static pressure gradient across the liquid rings depth, in turn due to the rotation of the rotor within the expander/compressor housing which pressurizes the liquid in a centrifugal field.

The liquid mist, by mixing intimately with the gas during its pressure changes, also serves another function. It strongly limits the temperature change in the gas compression (in the compressor) and expansion (in the expander) stages by providing finely divided, large surface area adjacent to the relatively large thermal capacity of the liquids to exchange heat effectively with the gas with very little temperature change. This improves the COP of the device by bringing these legs of the cycle closer to the isothermal ideal.

The fluid injection can be located in the compressor (expander) gas inlets as shown in FIG. 5. An alternative embodiment bas the mist injected directly into the compression (expansion) chamber by suitable modification of the compressor (expander) body, i.e., placing a liquid inlet proximate the chamber gas inlet.

In the operation of the preferred embodiment, the liquid in loop 26 acts as a heat sink for refrigeration. The warmed liquid, returning to the expander from a refrigeration heat exchanger (or other heat acceptor) is injected as a mist into the expanding cool gas, thereby greatly limiting the temperature change of the gas undergoing expansion by transferring the heat energy from the warmed liquid to the gas. By the time the liquid mist rejoins the liquid of the liquid ring, it is at a decreased temperature, which thereby substantially maintains the temperature of the liquid in the liquid ring at a suitable refrigeration temperature for loop 26.

The expanded cool gas is then forced out of the expander chamber (as the vanes approach the side of the housing) and passes through the recuperator where the gas is heated.

The liquid in compressor loop 20 acts to reject heat from the system. As in the expander loop 26, the heat exchanger of loop 20 may be a common variety wherein the liquid passes through a series of pipes that together have a large exterior surface. For loop 26, this surface is in contact with the ambient air (or forced air, or other final thermal sink) for heat transfer. Liquid returning from the heat exchanger is injected in a mist form into the hot gas entering the compressor. The gas and liquid mist mix intimately and heat from the gas undergoing compression is transferred to the liquid mist. As the heated mist is centrifuged into the liquid ring, it substantially maintains the temperature of the liquid ring at a suitable rejection temperature (above final sink temperature as required by the rejection heat exchanger). Heat is transferred directly from the gas to the liquid ring by the accretion of the mist droplets in the liquid ring. Hot liquid is continually tapped from the liquid ring and sent to the loop 20 heat exchanger for cooling. A large portion of the compressed hot gas exits the chamber when the discharge port is exposed. The compressed hot gas passes through the recuperator where it transfers energy to the lower-pressure gas about to enter the compressor. The cooled higher-pressure gas then moves to the expander where the cycle is repeated.

It should be noted that the heat exchangers are optional and could be replaced by an alternate source and sink for the liquids leaving and entering the liquid ring. For example, the hot water leaving the compressor liquid ring may be sent to a drain and a cool liquid fed into the liquid ring. Also, the liquid injection greatly enhances the operation of the system. However, a minimum functionality would occur without one or both (compressor and expander) of the injection systems.

Concerning powering the system, the preferred embodiment includes a coaxial arrangement for the compressor and expander with a single motor to turn the common shaft. This could be replaced by a compressor and expander individually motivated and operating mechanically independent of each other (with but a common gas loop).

Another application of this system is as a shaft-power-producing engine. In this case, the system is unchanged in design from its refrigeration layouts. However, the liquid in the expander loop is heated by a higher temperature external source and the heated liquid, when injected into the gas, limits the temperature change of the expanding gas. The expanding gas pushes outward on the face of the liquid ring, which reacts against the (radially) sloping wall of the housing, thereby causing the rotor to turn, providing torque. The compressor and its loop are as with the refrigeration embodiment except that their temperatures are lower than that of the expander and its loop. The machine performs work by accepting heat at a high temperature, while using it to expand a gas in a substantially isothermal process and rejecting it at a low temperature (at the compressor heat exchanger) while compressing a gas in a substantially isothermal process.

Another embodiment of this system is capable of cryogenic service, such as the liquefaction of nitrogen gas. A schematic of this system is shown in FIG. 6.

The primary difficulty in liquifying nitrogen is that the temperature change required to liquify nitrogen from room temperature (~300° K at atmospheric pressure) to the saturated liquid temperature (~77° K) is beyond the range of known liquids. Butene approaches this range by remaining liquid (down) to about 90° K.

Figure 6:
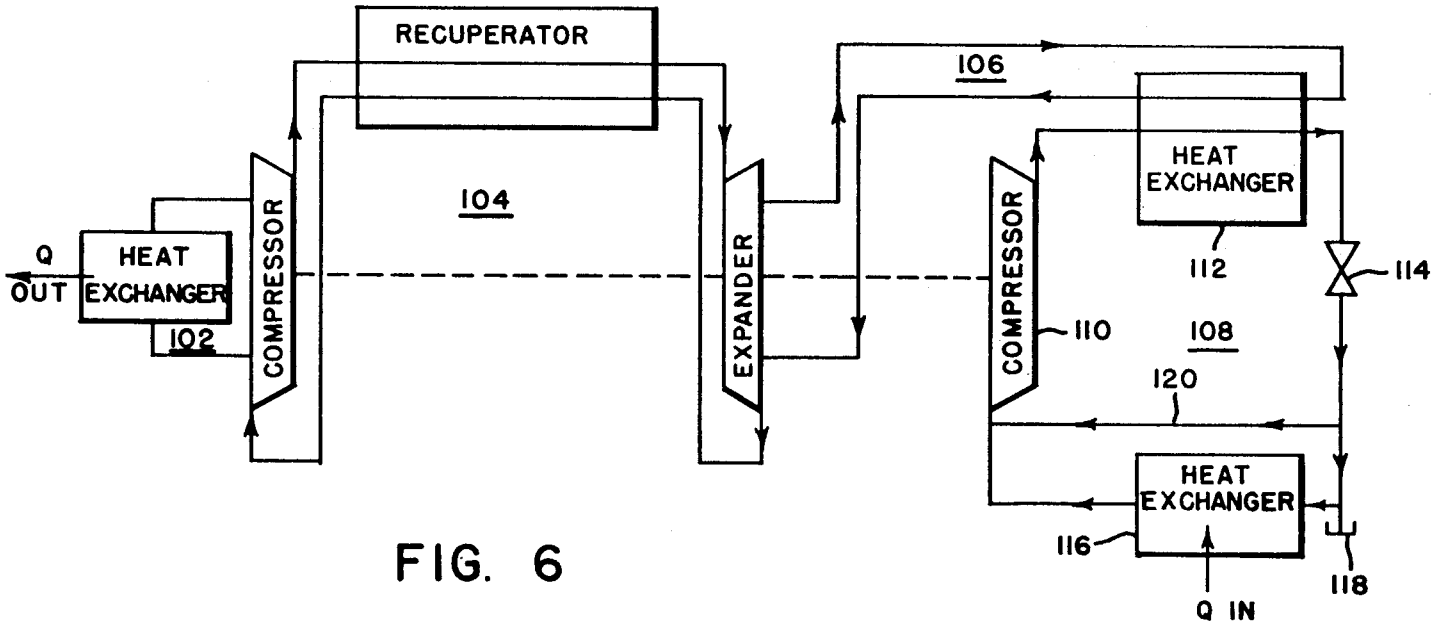
FIG. 6 is a schematic of the system used for cryogenic applications.

In the machine shown in FIG. 6, three fluid loops 102, 104 and 106 are used in a manner similar to the refrigeration apparatus shown in FIGS. 4 and 5. In addition, a nitrogen loop 108 is added. In this added loop, a compressor 110 is used to compress gaseous nitrogen to a point where it can be liquified at a slightly higher temperature (~90° K). The pressurized nitrogen then passes through a heat exchanger 112 where its temperature is reduced by a transfer of energy to the expander loop 106. Next, the high pressure (relatively low temperature, gaseous) nitrogen enters an expansion valve 114. Upon exiting the valve, the nitrogen, having undergone substantially adiabatic expansion, is at a lower pressure. The temperature of the nitrogen is thereby reduced to a point where at least a portion of the nitrogen condenses into a liquid form. The liquid nitrogen is then put to conventional use in a heat exchanger 116, or removed at tap 118. Nitrogen which remains gaseous after exiting the valve can be returned to the compressor via bypass 120. The nitrogen that returns to its gaseous state in the heat exchanger 116 is also returned to the compressor 110 to repeat the cycle.

The embodiments and procedures disclosed herein have been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention.

I claim:

1. A refrigeration system comprising:

a liquid-ring compressor having a liquid outlet, a liquid inlet, a gas outlet and a gas inlet;

a liquid-ring expander having a liquid outlet, a liquid inlet, a gas outlet and a gas inlet;

a recuperator having a first connector means which connects the compressor gas outlet to the expander gas inlet and a second connector means which connects the compressor gas inlet to the expander gas outlet, said recuperator including means whereby heat can be transferred between said first connector means and said second connector means;

a first heat exchanger comprising a connector means connecting said compressor liquid outlet to the compressor liquid inlet, said connector means being in contact with a heat transferring means whereby heat can be transferred from said connector means to said heat transferring means;

a second heat exchanger comprising a connector means connecting said expander liquid outlet to the expander liquid inlet, said connector means being in contact with a heat transferring means whereby heat can be transferred from said heat transferring means to said connector means; and at least one motor means operatively connected to said expander and said compressor for driving said compressor and said expander.

2. The refrigeration system of claim 1 wherein said compressor liquid inlet includes an injecting means for injecting a liquid from said liquid inlet in a mist form into an interior, gas containing portion of said compressor.

3. The refrigeration system of claim 2 wherein said expander liquid inlet includes an injecting means for injecting a liquid from said liquid inlet in a mist form into an interior, gas containing portion of said expander.

4. The refrigeration system of claim 1 wherein said expander liquid inlet includes an injecting means for injecting a liquid from said liquid inlet in a mist form into an interior, gas containing portion of said expander.

5. The system of claim 1 further comprising a means for modulating the capacity of the system whereby said means functions by altering the amount of liquid in the liquid ring of at least one of said compressor or expander.

6. The system of claim 1 further comprising a pressure regulator operatively connected to the compressor liquid ring, said regulator including means for adjusting the amount of liquid within the ring and thereby change the amount of liquid directed to the compressor liquid outlet.

7. The system of claim 6 further comprising a pressure regulator operatively connected to the expander liquid ring, said regulator including means for adjusting the amount of liquid within the ring.

8. The system of claim 1-further comprising a pressure regulator operatively connected to the expander liquid ring, said regulator including means for adjusting the amount of liquid within the ring and thereby change the amount of liquid directed to the expander liquid outlet.

9. The system of claim 1 wherein said compressor and said expander each include rotors that are connected to each other whereby rotation of one rotor causes rotation of the other rotor.

10. The refrigeration system of claim 1 further comprising:

a cryogenic loop comprising a compressor having a fluid inlet and a fluid outlet, an expansion means having a fluid inlet and fluid outlet, a first fluid connecting means connecting said compressor fluid outlet to said expansion means fluid inlet, at least a portion of said first fluid connecting means operatively connected to said second heat exchanger whereby heat can be transferred from the cryogenic loop first connecting means to said second heat exchanger connecting means; and whereby a fluid can enter the compressor through the inlet, be compressed by the compressor, travel through the first fluid connecting means where some of its heat is removed in the second heat exchanger, and then pass through the expansion means where the fluid expands and thereby decrease its temperature.

11. The system of claim 10 wherein at least a portion of the fluid exiting the expansion means is a liquid.

12. The system of claim 11 wherein the fluid used in the cryogenic loop is nitrogen.

13. The system of claim 12 wherein the liquid nitrogen from the expansion means fluid outlet passes through a third heat exchanger where it absorbs heat from a heat source, becomes at least partially vaporized and then is directed to the compressor fluid inlet.

14. The system of claim 12 wherein at least a portion of any nitrogen exiting the expansion means that is in gaseous form is directed to the compressor inlet.

15. A reverse-Ericsson system comprising:

a liquid-ring compressor having a liquid outlet, a liquid inlet, a gas outlet and a gas inlet;

a liquid-ring expander having a liquid outlet, a liquid inlet, a gas outlet and a gas inlet;

a recuperator having a first connector means which connects the compressor gas outlet to the expander gas inlet and a second connector means which connects the compressor gas inlet to the expander gas outlet, said recuperator including means whereby heat can be transferred from said first connector means to said second connector means; and at least one motor means operatively connected to said expander and said compressor for driving said compressor and said expander, whereby heat can be rejected from the system by a liquid exiting the compressor liquid outlet and heat can be added to the system by a liquid entering the expander liquid inlet.

16. The system of claim 15 further comprising an injecting means operatively connected to the expander whereby liquid from the liquid inlet can be injected in a mist form into a gas containing interior portion of the expander.

17. The system of claim 16 further comprising an injecting means operatively connected to the compressor whereby liquid from the liquid inlet can be injected in a mist form into a gas containing interior portion of the compressor.

18. The system of claim 15 further comprising an injecting means operatively connected to the compressor whereby liquid from the liquid inlet can be injected in a mist form into a gas containing interior portion of the compressor.

19. The system of claim 15 further comprising a means for modulating the capacity of the system whereby said means functions by altering the amount of liquid in the liquid ring of at least one of said compressor or expander.

20. A heat engine comprising:

a fluid-ring compressor having a fluid outlet, a fluid inlet, a gas outlet and a gas inlet;

a fluid-ring expander having a fluid outlet, a fluid inlet, a gas outlet and a gas inlet;

a recuperator having a first connector means which connects the compressor gas outlet to the expander gas inlet and a second connector means which connects the compressor gas inlet to the expander gas outlet, said recuperator or recuperator including means whereby heat can be transferred from said first connector means to said second connector means;

a first heat exchanger having a connector means connecting said compressor fluid outlet to the compressor fluid inlet, said connector means being in contact with a heat transferring means whereby heat can be transferred from said connector means to said heat transferring means;

a second heat exchanger having a connector means connecting said expander fluid outlet to the expander fluid inlet, said connector means being in contact with a heat transferring means whereby heat can be transferred from said heat transferring means to said connector means; and at least one shaft means operatively connected to said expander and said compressor for rotatably connecting a compressor rotor to a rotor housed within said expander, whereby heat entering the engine from the second heat exchanger provides the energy to turn the expanded and the compressor.

21. A heat engine comprising:

a liquid-ring compressor having a liquid outlet, a liquid inlet, a gas outlet and a gas inlet;

a liquid-ring expander having a liquid outlet, a liquid inlet, a gas outlet and a gas inlet;

a recuperator having a first connector means which connects the compressor gas outlet to the expander gas inlet and a second connector means which connects the compressor gas inlet to the expander gas outlet, said recuperator including means whereby heat can be transferred from said first connector means to said second connector means: and whereby heat can be rejected from the system by a liquid exiting the compressor liquid outlet and heat can be added to the system by a liquid entering the expander liquid inlet.

22. The system of claim 21 further comprising a means for modulating the capacity of the system whereby said means functions by altering the amount of liquid in the liquid ring of at least one to said compressor or expander.

23. A method of removing heat energy comprising:

providing a compressor means and an expander means with at least one of said compressor means or expander means having a liquid piston means;

connecting the compressor means and expander means with a gas loop for the transferring of energy from one to the other;

operatively connecting a heat exchanger means to the compressor means whereby heat energy can be rejected from said heat exchanger means;

operatively connecting a heat exchanger means to the expander means whereby heat energy can be accepted into said heat exchanger means associated with the expander; and then operating said compressor means and said expander means whereby heat energy can be removed from an area by being accepted into said heat exchanger means connected to said expander means and said energy can then be rejected into another area via the heat exchanger means connected to the compressor means.

24. The method of claim 23 further comprising the use of an injector means for injecting a liquid into a gas containing area of the compressor means.

25. The method of claim 24 further comprising the use of an injector means for injecting a liquid into a gas containing area of the expander means.

26. The method of claim 23 further comprising the use of a recuperator in the gas loop to transfer energy between the gas leaving the compressor means and the gas entering the compressor means.

27. The method of claim 23 further comprising the use of a liquid ring compressor as the compressor means whereby liquid is tapped from the liquid ring and directed into the heat exchanger means connected to the compressor means.

28. The method of claim 27 further comprising using a pressure regulator connected to the liquid ring to adjust the amount of liquid within the ring and thereby adjust the flow of liquid to the heat exchanger means connected to the compressor means.

29. The method of claim 23 further comprising the use of a liquid ring expander as the expander means whereby liquid is tapped from the liquid ring and directed into the heat exchanger means connected to the expander means.

30. The method of claim 29 further comprising using a pressure regulator connected to the expander liquid ring to adjust the amount of liquid within the ring and thereby adjust the flow of liquid to the heat exchanger means connected to the expander means.

31. The method of claim 23 further comprising modulating the system capacity by altering the amount of liquid used in the piston means of the at least one of said compressor means or said expander means.

* * * * *